US011404792B2

(12) United States Patent
Tanaka

(10) Patent No.: US 11,404,792 B2
(45) Date of Patent: Aug. 2, 2022

(54) ANTENNA DEVICE

(71) Applicant: YOKOWO CO., LTD., Tokyo (JP)

(72) Inventor: Masato Tanaka, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 156 days.

(21) Appl. No.: 16/643,845

(22) PCT Filed: Sep. 5, 2018

(86) PCT No.: PCT/JP2018/032822
§ 371 (c)(1),
(2) Date: Mar. 3, 2020

(87) PCT Pub. No.: WO2019/049877
PCT Pub. Date: Mar. 14, 2019

(65) Prior Publication Data

US 2021/0066808 A1 Mar. 4, 2021

(30) Foreign Application Priority Data

Sep. 5, 2017 (JP) ..... JP2017-170247

(51) Int. Cl.
*H01Q 1/32* (2006.01)
*H01Q 13/10* (2006.01)
*H01Q 5/364* (2015.01)

(52) U.S. Cl.
CPC ..... *H01Q 13/10* (2013.01); *H01Q 1/3275* (2013.01); *H01Q 5/364* (2015.01)

(58) Field of Classification Search
CPC ..... H01Q 13/10; H01Q 5/364; H01Q 1/3275
See application file for complete search history.

(56) References Cited

U.S. PATENT DOCUMENTS 9,319,155 B2 * 4/2016 Rao ..... H01Q 1/243
2003/0122721 A1 * 7/2003 Sievenpiper ..... H01Q 9/14 343/767
2012/0009884 A1 1/2012 Rao et al.

FOREIGN PATENT DOCUMENTS

EP 2528165 A1 11/2012
EP 2811573 A1 12/2014
(Continued)

OTHER PUBLICATIONS

Stanley, "A Novel Reconfigurable Metal Rim Integrated Open Slot Antenna for Octa-Band Smartphone Applications", Manoj Stanley, IEEE Transactions on Antennas and Propagation, vol. 65, No. 7, Jul. 2017. (Year: 2017).*

(Continued)

*Primary Examiner* — Dieu Hien T Duong
(74) *Attorney, Agent, or Firm* — Xsensus LLP

(57) ABSTRACT

The present invention provides a small low-profile antenna device for a vehicle, the antenna device being able to achieve bandwidth widening and increase gain in a horizontal direction by being fixed to a predetermined part of the vehicle.

The antenna device for a vehicle includes a metal surface and a slot 110 is formed in the metal surface with a slit 111 provided at a part of edges of the slot 110. The slot faces a direction parallel to the ground with a first power feed unit G1 being provided on inner edges of the slot. A slot 120, in which the slit 111 is provided, operates as a slot antenna adapted to transmit or receive signals in four or more frequency bands.

16 Claims, 11 Drawing Sheets

(56) References Cited

FOREIGN PATENT DOCUMENTS

| | | | | |
|---|---|---|---|---|
| JP | 02-241207 | A | 9/1990 | |
| JP | 061710/1991 | U | 6/1991 | |
| JP | 2002-135045 | A | 5/2002 | |
| JP | 2004-242034 | A | 8/2004 | |
| JP | 2012-518371 | A | 8/2012 | |
| JP | 2016-504799 | A | 2/2016 | |
| WO | WO-2015111768 | A1 * | 7/2015 | ..... H04B 7/0413 |
| WO | 2017/058177 | A1 | 4/2017 | |
| WO | 2017/076750 | A1 | 5/2017 | |

OTHER PUBLICATIONS

International Search Report and Written Opinion dated Nov. 20, 2018 for PCT/JP2018/032822 filed on Sep. 5, 2018, 7 pages including English Translation of the International Search Report.
Extended European search report dated Apr. 23, 2021, in corresponding European patent Application No. 18854870.5, 12 pages.

* cited by examiner

ANTENNA DEVICE

CROSS-REFERENCE TO RELATED APPLICATIONS

The present application is based on PCT filing PCT/JP2018/032822, filed Sep. 5, 2018, which claims priority to JP 2017-170247, filed Sep. 5, 2017, the entire contents of each are incorporated herein by reference.

TECHNICAL FIELD

The present invention relates to a small low-profile antenna device suitable for applications such as telematics.

BACKGROUND ART

In recent years, there has been increasing demand for telematics for vehicles carrying communications equipment. Telematics is a combination of the words "telecommunication" and "informatics", and is a technique for providing information and services in real time to communications equipment of a vehicle using a mobile communications system and the like.

As a technique for responding to such demand, for example, Patent Literature 1 discloses an antenna device that conducts MIMO communication using a frequency band of LTE (Long Term Evolution) communication. The LTE communication is a communications mode that speeds up the third generation (3G) communication. The MIMO (Multiple-Input Multiple-Output) communication is a communications mode that uses plural antennas, transmits different data from each antenna, and receives data simultaneously by the plural antennas.

The antenna device disclosed in Patent Literature 1 includes plural antennas housed in a shark fin antenna housing with length 100 mm, width 50 mm, and height 45 mm. One of the antennas is an unbalanced antenna, i.e., a monopole antenna, which determines the height of the antenna device. Not only the antenna device disclosed in Patent Literature 1, but also antenna devices mounted on vehicles use a vehicle roof as a ground plane, and thus monopole antennas are used often.

PRIOR ART DOCUMENTS

Patent Literature

Patent Literature 1: National Publication of International Patent Application No. 2016-504799

SUMMARY OF INVENTION

Problems to be Solved by the Invention

Preferably the antennas used for LTE communication and MIMO communication have high gain in the horizontal direction (direction parallel to the ground) orthogonal to the zenith direction (upward in the vertical direction). Also, antenna devices mounted on vehicles are required to be small and low-profile.

However, if a monopole antenna is made low-profile as with the antenna device disclosed in Patent Literature 1, the antenna size (height) in the zenith direction decreases, resulting in deterioration of a VSWR (Voltage Standing Wave Ratio) and shortage of gain in the horizontal direction. The monopole antenna can be made low-profile to some extent by loading an antenna coil and the like to satisfy a resonance condition or interposing an impedance matching circuit, but it is difficult to reduce deterioration of VSWR of the antenna itself or gain in the horizontal direction. Also, to conduct MIMO communication using an antenna device for a vehicle, it is necessary to mount plural antennas, and thus there is a limit to downsizing.

An object of the present invention is to provide a small low-profile antenna device that can properly transmit and/or receive signals in a wide frequency band without providing an antenna coil and increase gain in the horizontal direction.

Solution to Problem

The present invention provides an antenna device for a vehicle, the antenna device being fixed to a predetermined part of the vehicle and comprising at least one metal surface, wherein: a slot is formed in the metal surface with a slit provided at a part of edges of the slot; the slot faces a direction parallel to the ground; and a power feed unit is provided on inner edges between either slot end of the slot and the slit.

Advantageous Effects of Invention

When a slot is used as an antenna element, a direction orthogonal to the antenna element corresponds to main polarization. Also, gain in an opening direction of the slot becomes high. In the antenna device according to the present invention, since the slot facing a direction parallel to the ground is formed in the metal surface, the gain in the direction parallel to the ground becomes high. In the metal surface, since the slit is provided at a part of edges of the slot and the power feed unit is provided on inner edges between either slot end of the slot and the slit, types of available frequency bands increase compared to when there is no slit. That is, bandwidth can be widened.

DESCRIPTION OF EMBODIMENTS

Description will be given below of an example of embodiments resulting from application of the present invention to a vehicle-mount type antenna device that can be used in telematics. The antenna device can be used for reception from global satellite measurement systems as well as, for example, in LTE and V2X (Vehicle-to-everything). V2X is a communications mode that enables communication between communications equipment of a vehicle and everything around the vehicle. The antenna device is used as a vehicle-mounted antenna device housed in a storage space of a housing.

Figure 1:
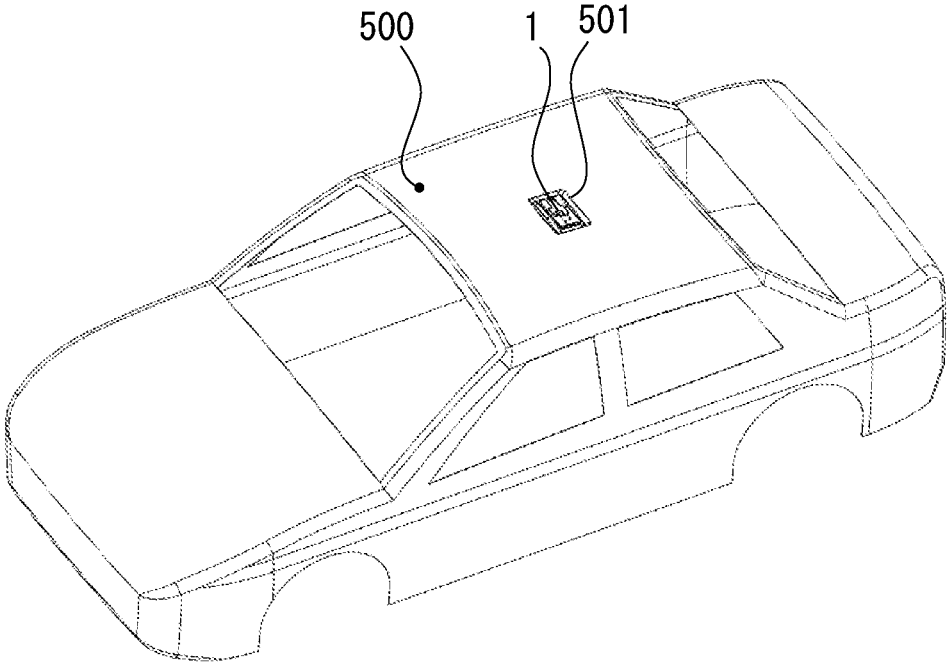
FIG. 1 is a diagram illustrating installed condition of an antenna device according to an embodiment of the present invention.

FIG. 1 is a diagram illustrating installed condition of an antenna device according to an embodiment of the present invention. The antenna device 1 is made up of an antenna unit housed in a radio-wave transparent housing of a predetermined shape and predetermined size, allowing itself to be used by being mounted, for example, in a depression 501 on a vehicle roof 500. There is no significant difference in average gain in a horizontal direction between when the antenna device 1 is placed in the depression 501 and when placed on a vehicle roof 500 without a depression. The reason for this will be described later. Therefore, gain can be obtained at every azimuth in a horizontal plane without impairing vehicle design.

The antenna unit has a resin-made rectangular box-shaped enclosure (hereinafter simply referred to as an "enclosure") whose short sides are approximately 100 mm, long sides are approximately 200 mm, and height is approximately 17 mm. Slots and slits are formed integrally in the enclosure using LDS (Laser Direct Structuring) technology and electronic components and a circuit board are mounted in the enclosure. The LDS technology is a common technology that involves drawing a three-dimensional pattern on resin by abrasion and then selectively metal-plating only traces of the abrasion using laser. As a precondition for describing a configuration and working effects of the antenna device 1, the names of the faces of the enclosure or antenna unit used herein will be described with reference to FIG. 2.

Figure 2:
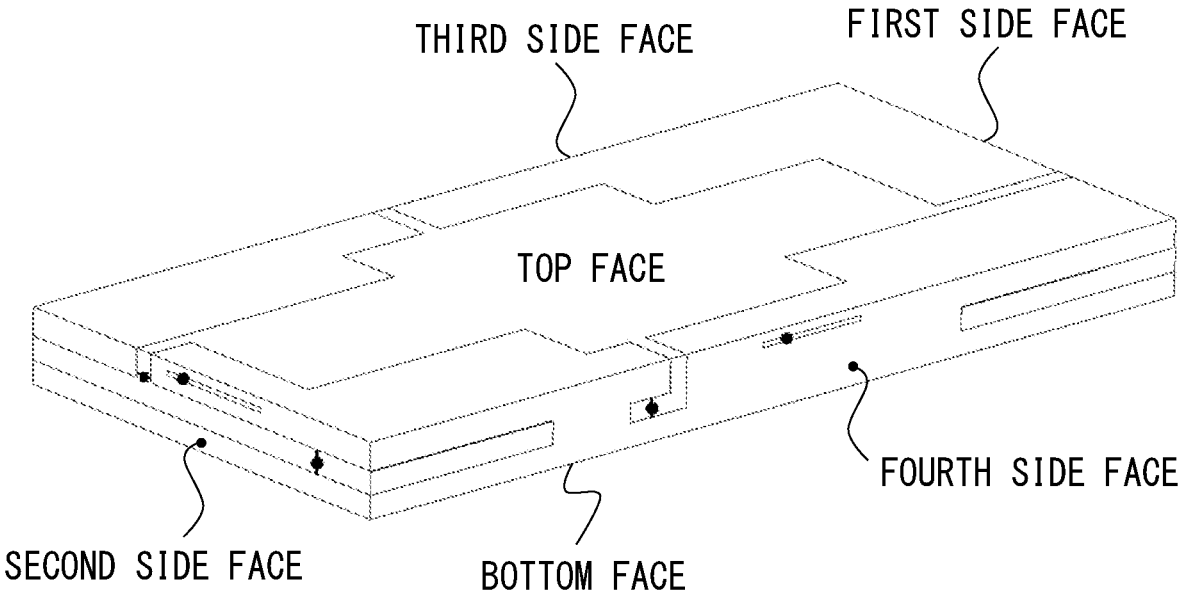
FIG. 2 is an explanatory diagram illustrating what are the names of faces of a rectangular enclosure.

FIG. 2 is a perspective view of the enclosure of the antenna unit with the housing removed. While details of patterns will be described later, hereinafter the entire short end face on the left side of FIG. 2 is referred to as a "second side face," the other entire short end face not visible in FIG. 2 is referred to as a "first side face," the entire long end face on the near side of FIG. 2 is referred to as a "fourth side face," and the entire long end face not visible in FIG. 2 is referred to as a "third side face."

The first side face, second side face, third side face, and fourth side face are orthogonal to a ground plane (plane at ground potential) and oriented in different directions at 90 degree intervals. Thus, all 360-degree directions are covered during use. Also, an entire upper base of the enclosure is referred to as a "top face" and an entire lower base not visible in FIG. 2 is referred to as a "bottom face." These faces are metal surfaces formed by covering areas on resin surfaces excluding predetermined patterns (patterns of plural slots and slits described later) with a metal film. These metal surfaces are placed in contact with other adjacent metal surfaces at a predetermined angle (90 degrees in this example).

One of the features of the antenna device 1 according to the present embodiment is that a pair of modified slot antennas, a pair of slit antennas, and a pair of second slot antennas, which have been widened in bandwidth, are formed in a single enclosure.

Figure 3A:
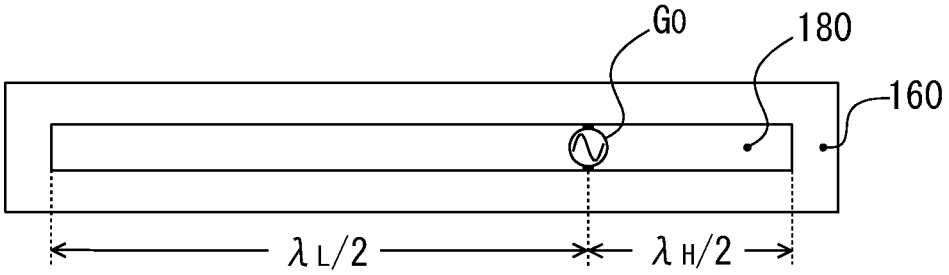
FIG. 3A is a pattern diagram for description of operation, illustrating a pattern in a reference side face.

First, a configuration and principles of bandwidth widening of the modified slot antennas according to the present embodiment will be described with reference to FIG. 3A and FIG. 3B. FIG. 3A is a pattern diagram of a reference face for description of operation.

A slot 180 serving as an antenna element is formed in a center portion of the reference side face. There is a metal film 160 around the slot 180. The slot 180 is parallel to the ground plane. A power feed unit Go for the slot 180 is provided on inner edges of the slot 180. The slot 180 includes a first slot end (closed end on the left side of FIG. 3A) and a second slot end (closed end on the right side of FIG. 3A), which face the power feed unit Go from opposite directions. The length from the first slot end to the power feed unit Go is ½ a wavelength $\lambda_L$ of a frequency used in a low-frequency band. Also, the length from the second slot end to the power feed unit Go is ½ a wavelength $\lambda_H$ of a frequency used in a high-frequency band, the second slot end being located on the opposite side of the slot 180 from the first slot end.

Figure 3B:
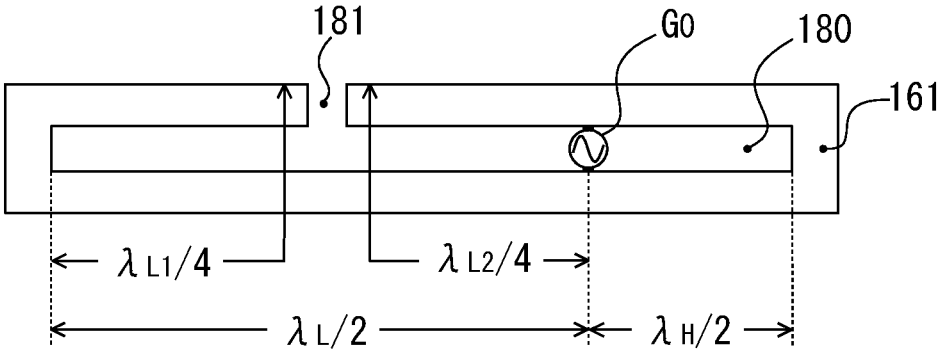
FIG. 3B is a pattern diagram for description of operation, illustrating a pattern in a modified slot antenna according to the present embodiment.

In contrast, FIG. 3B is a pattern diagram of a modified slot antenna, in which a slit 181 is formed in a part of edges of the slot 180. The modified slot antenna has the same element structure as in FIG. 3A except that a part of edges of a metal film 161 is notched to thereby provide the slit 181 at the part of edges. The length from the first slot end of the slot 180 to the power feed unit Go is ½ the wavelength $\lambda_L$ of the frequency used in a low-frequency band and the length from the second slot end of the slot 180 to the power feed unit Go is ½ the wavelength $\lambda_H$ of the frequency used in a high-frequency band. Also, the length from the first slot end of the slot 180 to an open end of the slit 181 is ¼ a wavelength $\lambda_{L1}$ of a frequency used in another low-frequency band. The length from the open end of the slit 181 to the power feed unit Go is ¼ a wavelength $\lambda_{L2}$ of a frequency used in still another low-frequency band.

The frequency available for use in each frequency band has a certain range (width). Therefore, when a wavelength or resonant length is mentioned, it is assumed that the term means a certain range (width) of wavelengths or resonant lengths centering around a frequency to be used. The wavelength $\lambda_{L1}$, wavelength $\lambda_L$, and wavelength $\lambda_{L2}$ are wavelengths of frequencies belonging to the low-frequency band, and the wavelength $\lambda_H$ is a wavelength of a frequency belonging to the high-frequency band.

In view of the above, the wavelength $\lambda_{L1}$ is a wavelength of the first frequency band, and that ¼ the wavelength $\lambda_{L1}$ is a resonant length of the first frequency band. Similarly, in view of the above, that the wavelength $\lambda_L$ is a wavelength of the second frequency band, and that ½ the wavelength $\lambda_L$ is a resonant length of the second frequency band. Similarly, in view of the above, the wavelength $\lambda_{L2}$ is a wavelength of the third frequency band, and that ¼ the wavelength $\lambda_{L2}$ is a resonant length of the third frequency band. Similarly, in view of the above, the wavelength $\lambda_H$ is a wavelength of the fourth frequency band belonging to the high-frequency band, and that ½ the wavelength $\lambda_H$ is a resonant length of the fourth frequency band.

As illustrated in FIG. 3B, the modified slot antenna operates as a slot antenna capable of transmitting and/or receiving not only signals in the second frequency band and signals in the fourth frequency band able to be transmitted and/or received by the slot antenna illustrated in FIG. 3A, but also signals in the first frequency band and signals in the third frequency band. This increases the number of frequency bands available for use, as compared with a case where the slit 181 is not provided, and thereby enables bandwidth widening. By further increasing the number of slits, it will become possible to transmit or receive signals in four or more frequency bands.

With the slot antenna of FIG. 3A and modified slot antenna of FIG. 3B, main polarization occurs in a direction orthogonal to the slot 180, which is a main element of the antenna. Therefore, the main polarization of these slot antennas becomes a vertically polarized wave. As long as the slot 180 is parallel to the ground plane, the main polarization of these slot antennas becomes a vertically polarized wave, therefore, the metal film 160 does not necessarily have to be perpendicular to the ground plane. Also, with the slot antenna, the gain in the direction of a plane in which the slot 180 is formed becomes high. Therefore, with these slot antennas, the gain of a vertically polarized wave in the horizontal direction, in which the slot 180 is oriented, i.e., in which the plane in which the slot 180 is formed is oriented, becomes relatively high. This tendency is also true of a slit antenna described later.

In the present embodiment, the modified slot antennas are applied to two LTE antennas capable of transmitting or receiving signals in the 700 MHz band, 800 MHz band, and 900 MHz band of LTE Low Band (low frequency bands: the same applies hereinafter) and 1.7 GHz to 2.7 GHz of LTE High Band (high frequency bands: the same applies hereinafter), respectively, that can be used in telematics and the like. That is, the sizes of the slit 181 and slot 180 are determined and the position of the power feed unit Go on the inner edges of the slot 180 is determined, such that, for example, the first frequency band will be the 700 MHz band, the second frequency band will be the 800 MHz band, the third frequency band will be the 900 MHz band, and the fourth frequency band will be 1.7 GHz to 2.7 GHz.

One of the two modified slot antennas is referred to as a "first LTE antenna" and the other is referred to as a "second LTE antenna." The first LTE antenna is formed together with a first power feed unit mainly on the first side face, third side face, and fourth side face of the rectangular box-shaped enclosure and the second LTE antenna is formed together with a second power feed unit mainly on the second side face, third side face, and fourth side face of the enclosure in such a way that the first LTE antenna and second LTE antenna will be point-symmetrical to each other.

In the present embodiment, the two slit antennas used in LTE High Band are also formed integrally with the enclosure. One of the slit antennas is referred to as a "third LTE antenna" and the other slit antenna is referred to as a "fourth LTE antenna." The third LTE antenna is formed together with a third power feed unit on the third side face of the enclosure. The fourth LTE antenna is formed together with a fourth power feed unit on the fourth side face of the enclosure.

In the present embodiment, two slot antennas (second slot antennas) used as V2X antennas are further formed integrally with the enclosure. An allocated frequency band for V2X is the 5.9 GHz band. One of the slit antennas is referred to as a "first V2X antenna" and the other slot antenna is referred to as a "second V2X antenna." The first V2X antenna is formed together with a fifth power feed unit on the fourth side face of the enclosure. The second V2X antenna is formed together with a sixth power feed unit on the second side face of the enclosure.

In the present embodiment, a receiving antenna for global satellite measurement systems such as a GNSS (Global Navigation Satellite System) patch antenna (a flat antenna placed parallel to the ground plane) is further provided together with its power feed unit and circuit board in the enclosure.

As described above, in the present embodiment, since the antenna unit, which is created using the LDS technology, is created by covering resin with a metal film, the GNSS patch antenna and circuit board are not visible in FIG. 2 as well as in FIG. 9 described later, but arrangement and the like of these components will be described later with reference to FIG. 8.

<Configuration Examples of Antennas>

Next, configuration examples of the antennas formed on respective metal surfaces of the enclosure will be described.

1. The First LTE Antenna (First Side Face, Third Side Face, Fourth Side Face, and Top Face)

Figure 4:
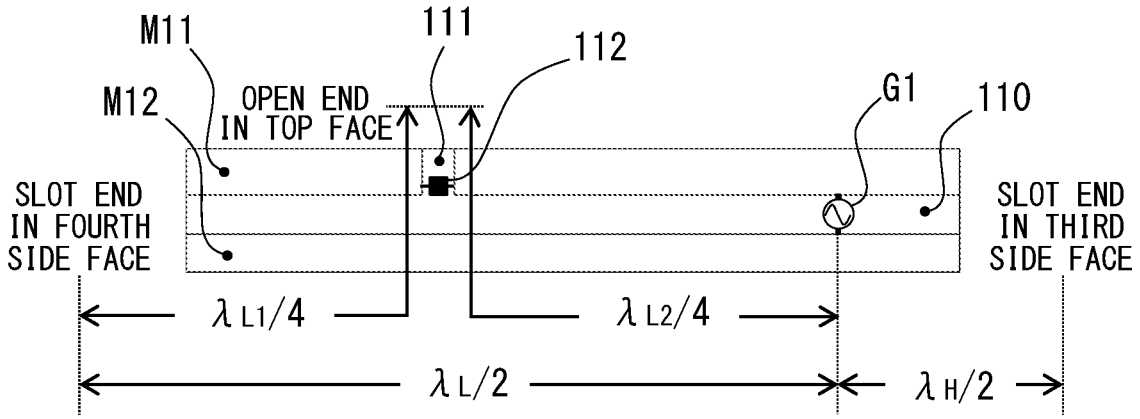
FIG. 4 is a diagram illustrating a pattern example of a first side face.

The first LTE antenna is a modified slot antenna made up of a combination of a slot formed across the first side face, third side face, and fourth side face of the enclosure and a slit formed across the first side face and top face. FIG. 4 is a diagram illustrating a pattern example of the first side face.

Referring to FIG. 4, in a center portion of the first side face, a slot 110 serving as a main element of the first LTE antenna is formed parallel to the ground plane. A slit 111 extending to the top face is provided at a part of edges of the slot 110. A first power feed unit G1 for the slot 110 is provided on inner edges of the slot 110 away from the slit 111. For example, when a coaxial cable is used, power is fed by the first power feed unit G1 with a core wire being connected to an upper edge (upper inner edge) of the slot 110 and with a ground wire being connected to a lower edge (lower inner edge) of the slot. This is also true of other power feed units except for a power feed unit of the patch antenna described later. A metal film is formed except for the slot 110 and slit 111. That is, a pair of metal films are formed on opposite sides of the slot 110, a metal film M11 is formed on a top side of the first side face, and a metal film M12 is formed on a bottom side.

A high-pass filter 112 is interposed in an aperture in a part of the slit 111 which borders on the slot 110. The high-pass filter 112 is designed to exhibit first impedance high enough to limit passage of signals in LTE Low Band and exhibit second impedance lower than the first impedance in LTE High Band. A switching element adapted to electrically open and close the aperture may be provided instead of the high-pass filter 112.

Operation of the first LTE antenna in Low Band is the same as the modified slot antenna of a basic configuration illustrated in FIG. 3B. That is, the length from an open end (open end in the top face) of the slit 111 to a slot end in the adjacent fourth side face corresponds to a resonant length of the 700 MHz band (¼ the wavelength $\lambda_{L1}$ in the illustrated example). As can be seen from FIG. 2, the "open end in the top face" means an end portion in which the aperture of the slit 111 widens. The length from the first power feed unit G1 to the slot end in the fourth side face corresponds to a resonant length of the 800 MHz band (½ the wavelength $\lambda_L$ in the illustrated example). The length from the open end (open end in the top face) of the slit 111 to the first power feed unit G1 corresponds to a resonant length of the 900 MHz band (¼ the wavelength $\lambda_{L2}$ in the illustrated example). Also, the length from the first power feed unit G1 to a slot end in the adjacent third side face corresponds to a resonant length of the 2000 MHz band (½ the wavelength $\lambda_H$ in the illustrated example). The length from the slot end in the third side face to the slot end in the fourth side face is equal to or more than twice a wavelength $\lambda_{H2}$ of the 2600 MHz band.

Consequently, signals in a wide frequency band including LTE Low Band and High Band can be transmitted and/or received using only the first LTE antenna formed on one metal surface of the enclosure. The first LTE antenna has high gain for vertically polarized waves in the horizontal direction, in which the first side face is oriented.

The first LTE antenna can be operated, for example, as a first antenna for 4×4 MIMO.

2. Second LTE Antenna and Second V2X Antenna (Second Side Face, Third Side Face, Fourth Side Face, and Top Face)

The second LTE antenna is a modified slot antenna made up of a combination of a slot formed across the second side face, third side face, and fourth side face of the enclosure and a slit formed across the second side face and top face.

Figure 5:
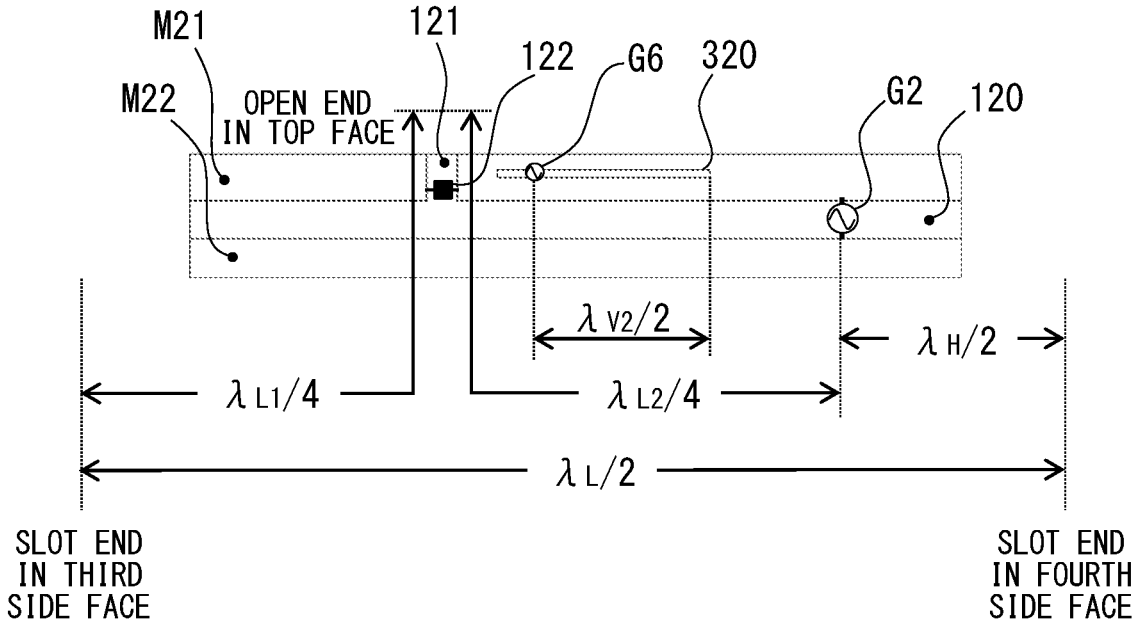
FIG. 5 is a diagram illustrating a pattern example of a second side face.

A pattern example of the second side face is illustrated in FIG. 5. A slot 120 serving as an antenna element of the second LTE antenna is formed in a center portion of the second side face. A slit 121 extending to the top face is provided at a part of edges of the slot 120. A second power feed unit G2 for the slot 120 is provided on inner edges of the slot 120 away from the slit 121. A high-pass filter 122 is interposed in an aperture in a part of the slit 121 which borders on the slot 120. Shapes, sizes, circuit constants, and operation details of the slot 120, slit 121, and high-pass filter 122 are the same as those of the first LTE antenna.

The second LTE antenna can be operated, for example, as a second antenna for 4×4 MIMO. The second LTE antenna has a structure point-symmetrical to that of the first LTE antenna when viewed from the top face. This makes it possible to secure a longer distance between the power feed units than when an axisymmetric structure is used and thereby reduce a correlation with the first LTE antenna. This in turn makes it possible, for example, to improve the throughput of MIMO communication.

A slot 320 (second slot) operating as a second V2X antenna is also formed in the second side face. A sixth power feed unit G6 is provided on inner edges of the slot 320. The length from the sixth power feed unit G6 to an end portion of the slot 320 is ½ the wavelength $\lambda_v$ of the 5.9 GHz band of V2X (resonant length of frequency band of V2X). A metal film is formed except for the slots 120 and 320 and slit 121. That is, a pair of metal films are formed on opposite sides of the slot 120, a metal film M21 is formed on a top side of the second side face, and a metal film M22 is formed on a bottom side. The second LTE antenna has high gain for vertically polarized waves in the horizontal direction, in which the second side face is oriented.

3. Third LTE Antenna (Top Face and Third Side Face)

Figure 6:
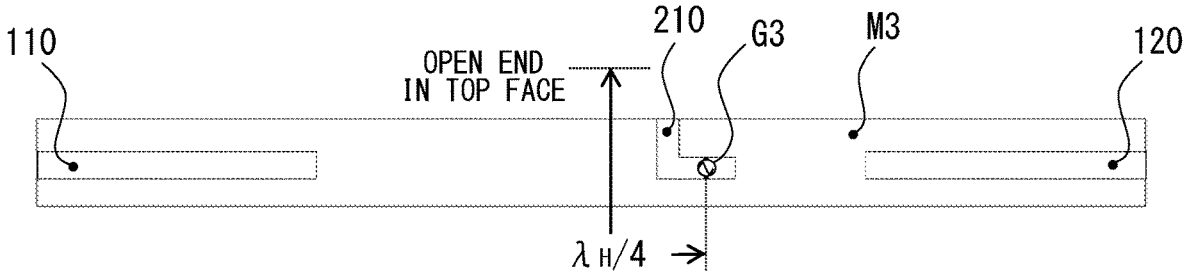
FIG. 6 is a diagram illustrating a pattern example of a third side face.

The third LTE antenna is a slit antenna formed across the top face and third side face of the enclosure. A pattern example of the third side face is illustrated in FIG. 6. Of a slit 210 serving as a main element of the third LTE antenna, an open end is formed in the top face and a closed end is formed at a location slightly offset toward the slot 120 from the midpoint between the slot 110 of the first LTE antenna and slot 120 of the second LTE antenna. In the third side face, the slit 210 is cut from the top face toward the bottom face substantially to the middle of the thickness, then changes direction toward the slot 120 of the second LTE antenna, and right afterwards terminates at a closed end. A third power feed unit G3 for the slit is provided approximately in the midsection between the direction change position and the closed end. The length from the third power feed unit G3 to the open end of the slit is ¼ the wavelength $\lambda_H$ of the 2000 MHz band in LTE High Band. A metal film M3 is formed except for the slots 110 and 120 and slit 210.

Being separated by a sufficient distance from the slots 110 and 120, the third LTE antenna can be prevented from interfering with the first LTE antenna and second LTE antenna. In particular, interference with the slot 110 of the first LTE antenna can be prevented more reliably, the slot 110 being located at a relatively large distance.

The third LTE antenna has high gain for vertically polarized waves in the horizontal direction, in which the third side face is oriented.

The third LTE antenna can be operated, for example, as a third antenna of 4×4 MIMO antennas.

4. Fourth LTE Antenna and First V2X Antenna (Top Face and Fourth Side Face)

Figure 7:
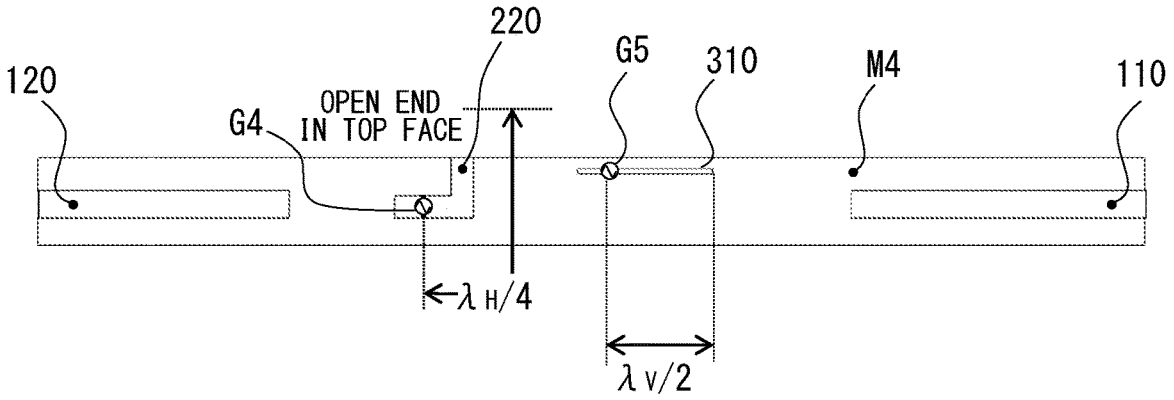
FIG. 7 is a diagram illustrating a pattern example of a fourth side face.

The fourth LTE antenna is a slit antenna formed across the top face and fourth side face of the enclosure. A pattern example of the fourth side face is illustrated in FIG. 7. Of a slit 220 serving as a main element of the fourth LTE antenna, an open end is formed in the top face and a closed end is formed at a location slightly offset toward the slot 120 from the midpoint between the slot 110 of the first LTE antenna and slot 120 of the second LTE antenna. In the fourth side face, the slit 220 is cut from the top face toward the bottom face substantially to the middle of the thickness, then changes direction toward the slot 120 of the second LTE antenna, and right afterwards terminates at a closed end. A fourth power feed unit G4 for the slit 220 is provided on inner edges approximately in the midsection between the direction change position and the closed end. The length from the fourth power feed unit G4 to the open end of the slit corresponds, for example, to a resonant length of the 2000 MHz band in LTE High Band (e.g., ¼ the wavelength $\lambda_H$ of the frequency band).

Being separated by a sufficient distance from the slots 110 and 120, the fourth LTE antenna can be prevented from interfering with the first LTE antenna and second LTE antenna.

The fourth LTE antenna has high gain for vertically polarized waves in the horizontal direction, in which the fourth side face is oriented.

The fourth LTE antenna can be operated, for example, as a fourth antenna for 4×4 MIMO.

A slot 310 operating as the first V2X antenna is also formed in the fourth side face. A fifth power feed unit G5 for the slot 310 is provided in the slot 310. The length from the fifth power feed unit G5 to an end portion of the slot 310 corresponds to a resonant length of the 5.9 GHz band of V2X (e.g., ½ the wavelength $\lambda_v$ of a frequency band allocated to V2X). A metal film M4 is formed except for the slots 110, 120, and 310 and slit 220. The first V2X antenna can be used together with the second V2X antenna as a diversity antenna.

5. Patch Antenna and Circuit Board (Top Face)

Figure 8:
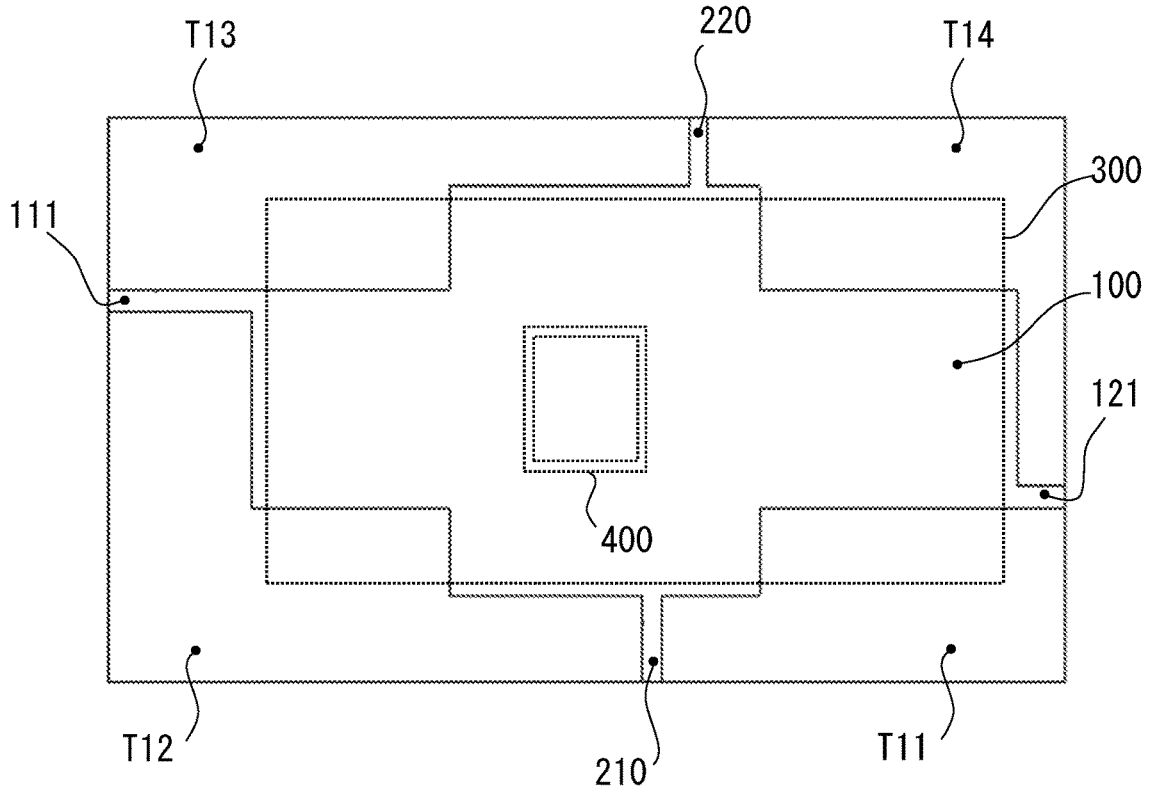
FIG. 8 is a diagram illustrating a pattern example on a top face.
Figure 9:
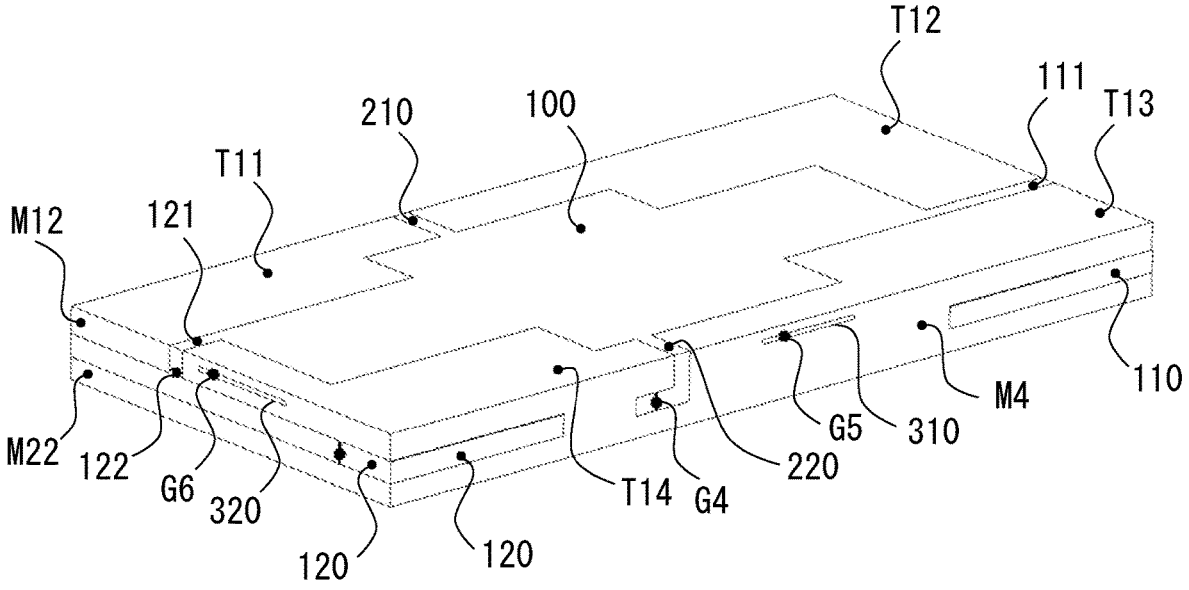
FIG. 9 is an external view of an antenna unit according to the present embodiment.

FIG. 8 is a pattern diagram of the top face and FIG. 9 is an external view of the antenna unit (the same as FIG. 2).

A circuit board 300 and patch antenna 400 placed parallel to the ground plane in the enclosure are indicated by broken lines in FIG. 8. The placement location, shape, and size of the circuit board 300 are determined such that outer edges of the circuit board 300 will not overlap any of the slits 111, 121, 210, and 220 and slots 110, 120, 310, and 320. In addition to the patch antenna 400 and a power feed unit of the patch antenna 400, the first power feed unit to the sixth power feed unit and circuit components electrically continuous with electronic equipment of the vehicle are mounted on the circuit board 300. A ground wire (GND) of the circuit board 300 is electrically connected to the enclosure bottom face on which a metal film is formed.

Four slits 111, 121, 210, and 220 are formed in a resin top 100, and consequently four metal films T11, T12, T13, and T14 are formed on the top face, an exposing part of the resin top 100. In the exposed part of the resin top 100, two rectangles of different sizes intersect each other to thereby form a cross.

The metal film T11 on the top face is integral with the metal film M21 which is one of metal films, from the end of the second side surface to the slit 121, on the second side face and with the metal film M3 on the third side face. The metal film T12 on the top face is integral with the metal film M3 on the third side face and with the metal film M11 which is one of metal films, from the end of the first side surface to the slit 111, on the first side face. The metal film T13 on the top face is integral with the metal film M11 which is one of metal films, from the end of the first side surface to the slit 111, on the first side face and with the metal film M4 on the fourth side face. The metal film T14 on the top face is integral with the metal film M4 on the fourth side face and with the metal film M21 which is one of metal films, from the end of the second side surface to the slit 121 on the second side face. Since a metal film is also formed on the bottom face, the metal films T11, T12, T13, T14, M11, M12, M21, M22, M3, and M4 are electrically continuous with one another.

In this way, by securing larger areas of metal around the slots 110, 120, 310, and 320 and slits 111, 121, 210, and 220, it is possible to expand frequency bands in which transmission and/or reception can be conducted and thereby increase antenna efficiency compared to when such areas of metal cannot be secured. Also, when any of the antennas is mounted on a vehicle roof 500, if the enclosure bottom face is electrically connected to the vehicle roof 500, the vehicle roof 500 can be used as metal around the slots 110, 120, 310, and 320 and slits 111, 121, 210, and 220, making it possible to improve antenna performance compared to in free space. Therefore, even if the antenna is placed in a depression surrounded by metal, deterioration of VSWR and gain in the horizontal direction is reduced compared to conventional monopole antennas.

Figure 10:
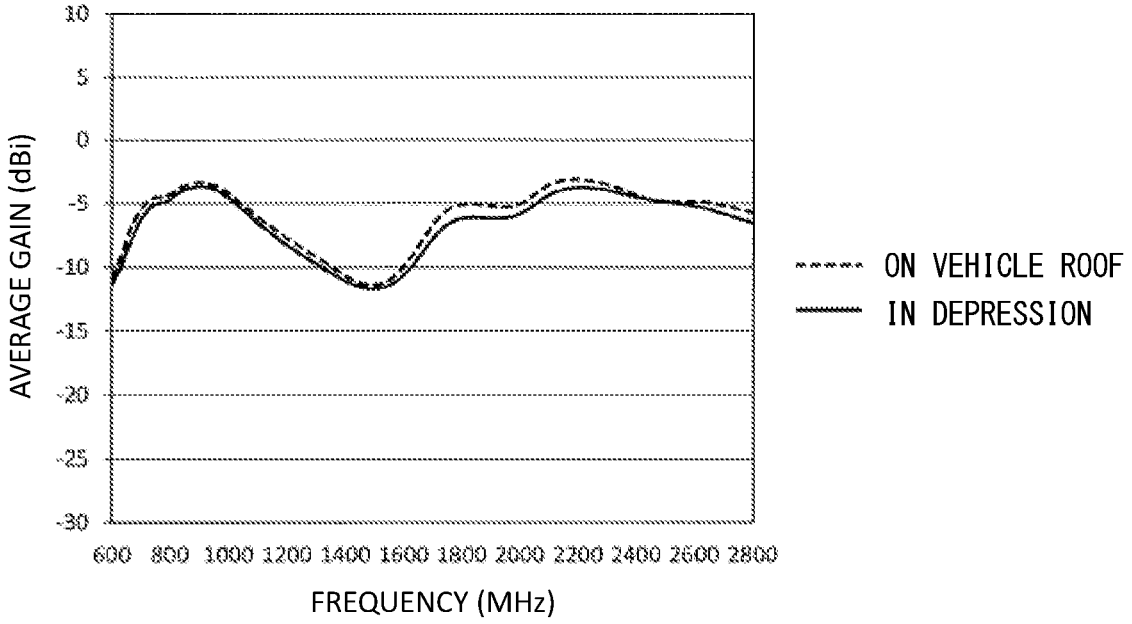
FIG. 10 is a characteristics comparison diagram of LTE's average gain vs. frequency.

FIG. 10 is a characteristics comparison diagram of average gain in the horizontal direction based on differences in installed condition of the antenna device 1 and is result data of a predetermined simulator. The ordinate in FIG. 10 represents average gain (dBi) and the abscissa represents frequency (MHz). The solid line in FIG. 10 represents average gain obtained when the antenna device 1 is attached to the depression 501 on the vehicle roof 500 as illustrated in FIG. 1. The broken line represents average gain obtained when the antenna device 1 is attached directly to the vehicle roof 500 without providing a depression 501. Referring to FIG. 10, there is no significant difference in average gain between these conditions. This means that the antenna device 1 according to the present embodiment eases restrictions on mounting positions on vehicles.

If a monopole antenna or dipole antenna is used for an antenna unit of a vehicle-mounted antenna device, placement of the antenna device in a rear part of the vehicle roof will result in reduced gain in the horizontal direction, and thus it is considered desirable to place the antenna device in a front part of the vehicle roof. However, there is a problem in that placement of the antenna device in the front part of the vehicle roof will impair vehicle design, and improvement is desired. The antenna device 1 according to the present embodiment eases restrictions on mounting positions and allows gain to be obtained at every azimuth in a horizontal plane. This solves the above problem. The antenna performance on the first side face to fourth side face of the antenna device 1 according to the present embodiment will be described later.

Comparative Example

The present inventors compared VSWR characteristics of the first LTE antenna formed on the first side face with VSWR characteristics of a comparative slot antenna having the same element structure except that the slit 111 was not formed in a part of edges of the slot 110 (the high-pass filter 112 was not added to the aperture of the slit 111, either), i.e., only the slot 110 was provided.

Figure 11:
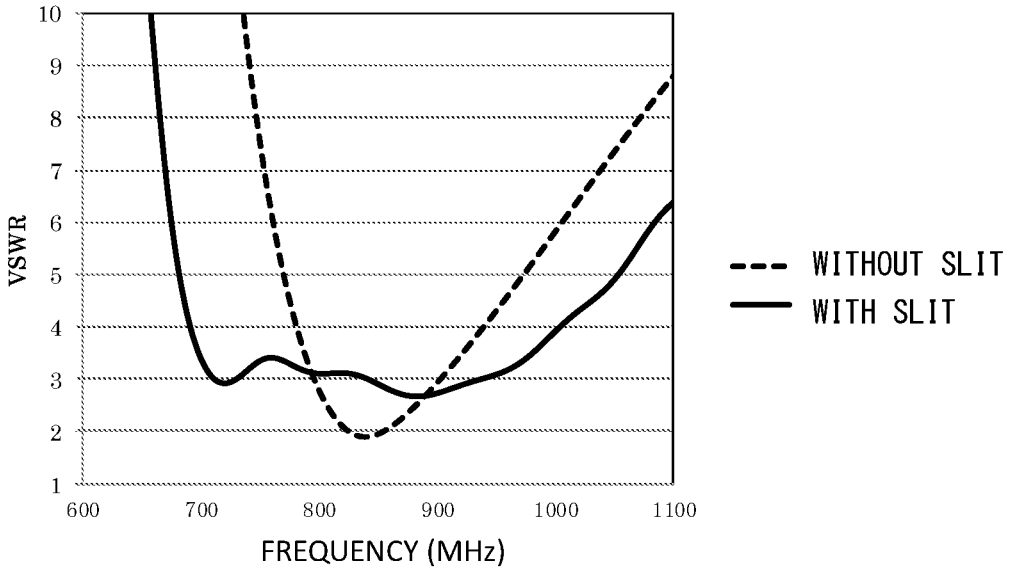
FIG. 11 is a comparison diagram of VSWR characteristics in LTE Low Band.

FIG. 11 is a comparison diagram of VSWR characteristics in LTE Low Band of the two antennas, illustrating measurement results produced by a predetermined simulator based on data of the first power feed unit G1. The solid line represents VSWR characteristics obtained when the slit 111 was provided and the broken line represents VSWR characteristics obtained when the slit 111 was not provided. Relationships (an extract) between frequency (MHz) and VSWR are as follows.

| Frequency (MHz) | Without slit | With slit (present embodiment) |
|---|---|---|
| 686 | 25.85 | 4.45 |
| 721 | 13.23 | 2.91 |
| 882 | 2.48 | 2.66 |
| 938 | 3.94 | 2.99 |
| 1001 | 5.83 | 3.91 |
| 1050 | 7.33 | 4.87 |

In this way, it can be seen that when the slit 111 is formed in a part of edges of the slot 110 as with the present embodiment, far greater bandwidth widening can be achieved, as compared with a case where the slit 111 is not provided, with VSWR being less than 3 in the 700 MHz band, 800 MHz band, and 900 MHz band of LTE Low Band. This makes it possible to implement a wide-band antenna having high gain for vertically polarized waves in the horizontal direction and excellent VSWR characteristics in frequency bands allocated to LTE in spite of a small low-profile design.

Figure 12:
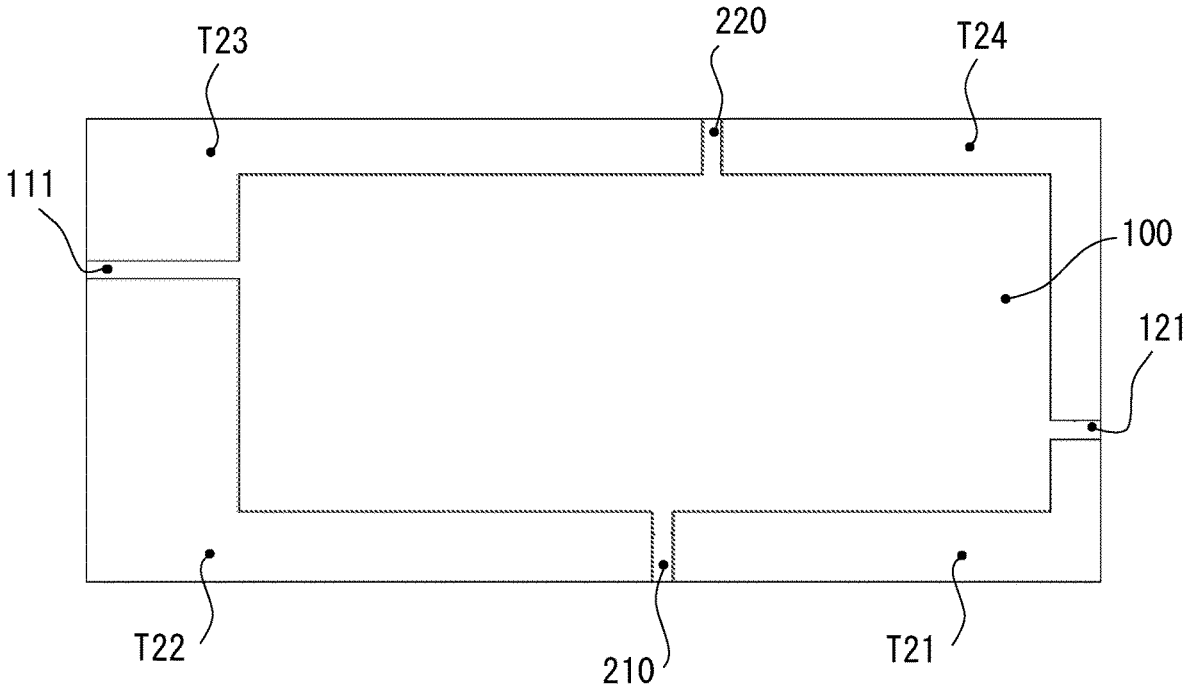
FIG. 12 is a diagram illustrating a pattern example on a top face of an antenna according to a comparative example.

In the present embodiment, description has been given of an example in which the metal films T11 to T14 are formed such that in the exposed part of the resin top 100, two rectangles of different sizes intersect each other, drawing a cross as illustrated in FIG. 8. To verify the influence of the exposed part, the present inventors created a comparative antenna in which the exposed part of the resin top 100 was rectangular as illustrated in FIG. 12. In the comparative antenna, the proportion of the metal film in the resin top 100 was lower than in the present embodiment.

Figure 13:
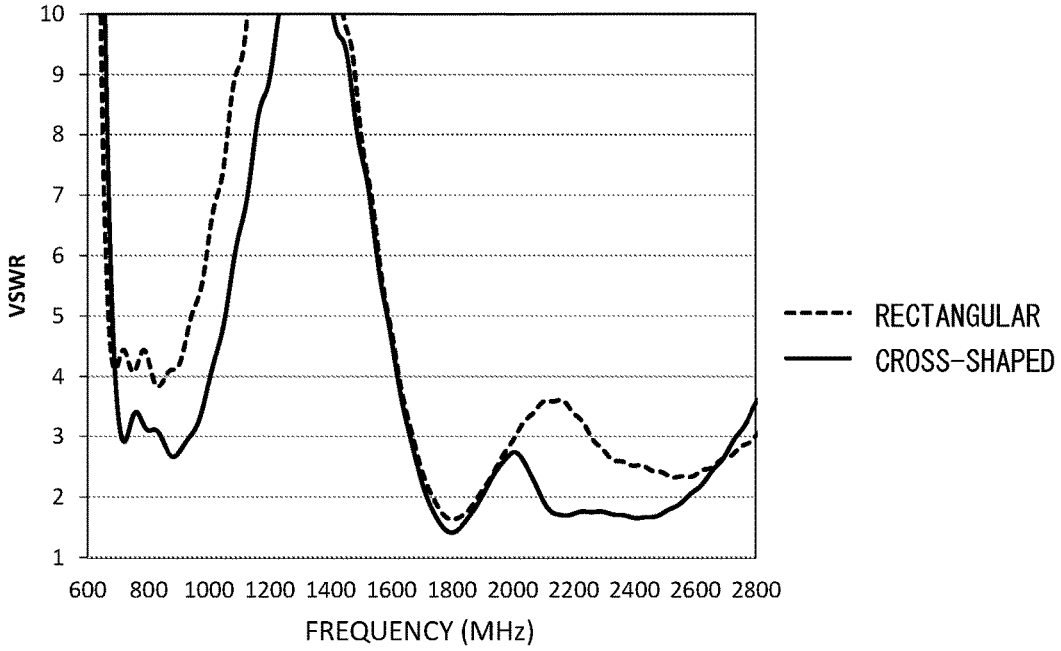
FIG. 13 is a comparison diagram of VSWR characteristics between antennas according to the present embodiment and a comparative example.

FIG. 13 is a comparison diagram of VSWR characteristics in LTE frequency bands between antennas according to the present embodiment and a comparative example. Referring to FIG. 13, in the antenna unit of the present embodiment in which the exposed part of the resin top 100 is cross-shaped, the minimum value of VSWR in LTE Low Band is 2.66 (at 882 MHz) and VSWR is less than 4 in the frequency band of 315 MHz. On the other hand, in the case of the comparative antenna in which the resin top 100 is rectangular, the minimum value of VSWR is 3.85 (at 833 MHz) and VSWR is less than 4 in the frequency band of only 35 MHz.

This tendency is also true of LTE High Band.

In this way, it was found that by forming the metal films T11 to T14 such that the exposed part of the resin top 100 will be cross-shaped, it is possible to reduce VSWR in the LTE frequency bands and widen the available frequency ranges.

<Electrical Characteristics>

The antenna performance (electrical characteristics) on side faces of the antenna device 1 according to the present embodiment will be described.

Figure 14A:
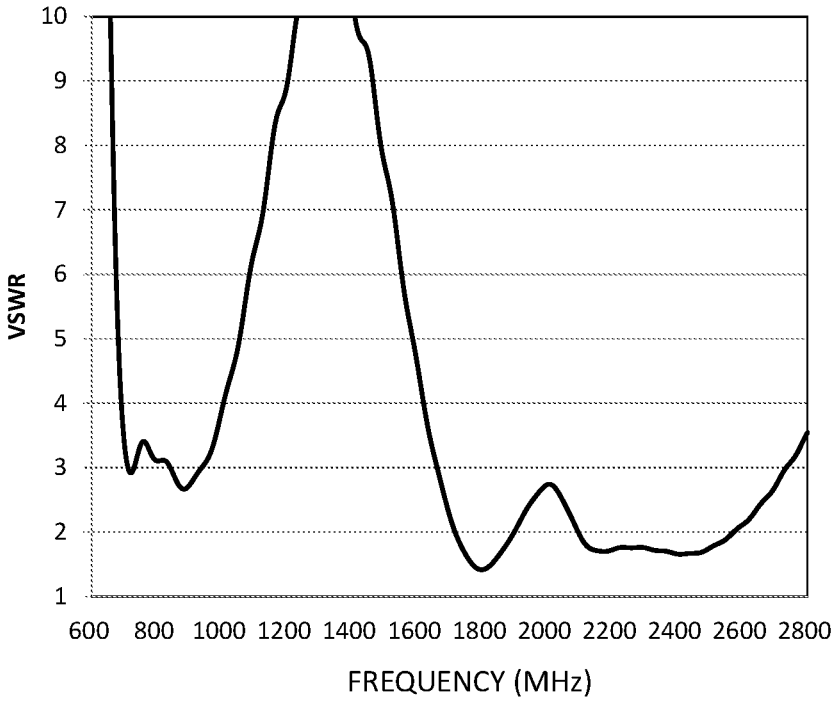
FIG. 14A is a VSWR characteristics diagram of a first power feed unit G1 on the first side face.
Figure 14B:
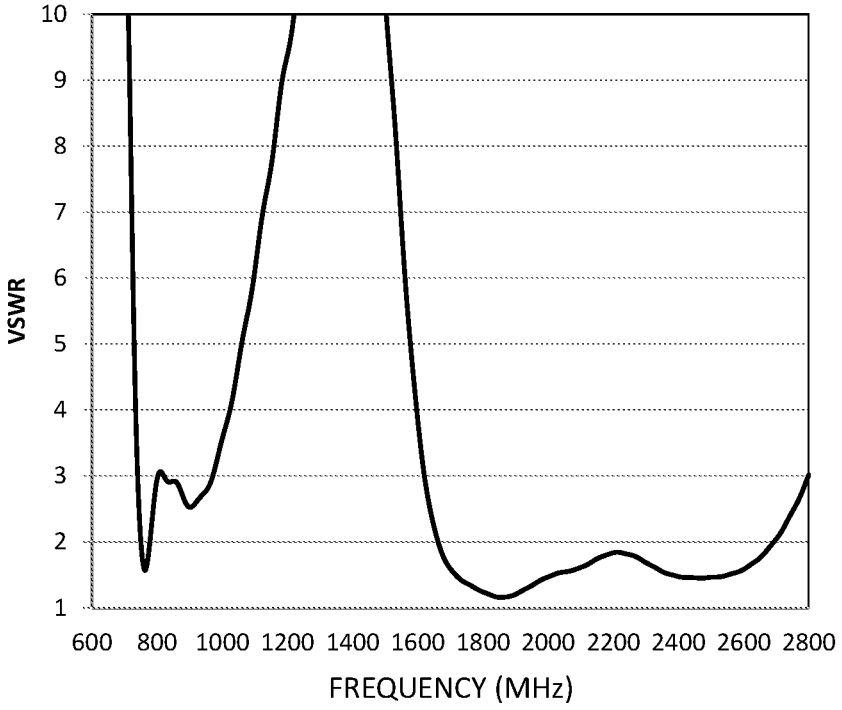
FIG. 14B is a VSWR characteristics diagram of a second power feed unit G2 on the second side face.

FIG. 14A is a VSWR characteristics diagram of the first power feed unit G1 on the first side face, details of which are as described with reference to the comparison diagram of VSWR characteristics in FIG. 11. FIG. 14B is a VSWR characteristics diagram of the second power feed unit G2 on the second side face. It can be seen that the second LTE antenna in the second side provides VSWR characteristics equal to or better than the first LTE antenna on the first side face.

Figure 15A:
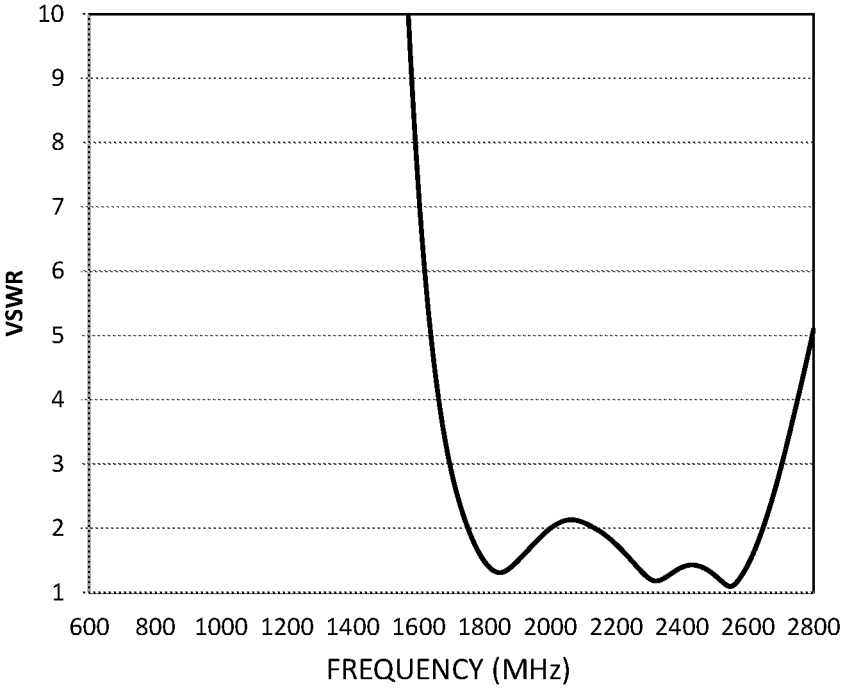
FIG. 15A is a VSWR characteristics diagram of a third power feed unit G3 on the third side face.
Figure 15B:
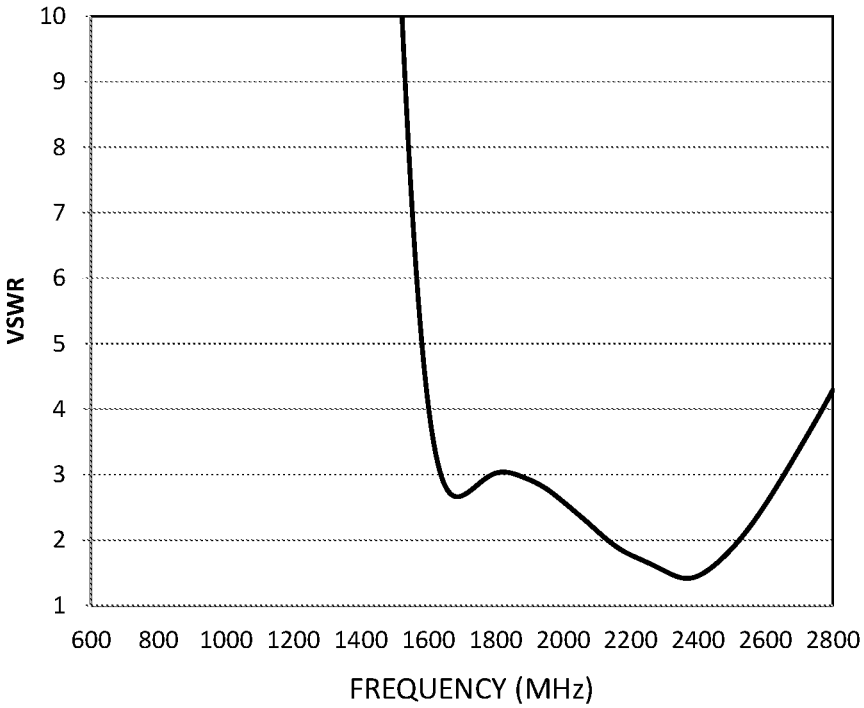
FIG. 15B is a VSWR characteristics diagram of a fourth power feed unit G4 on the fourth side face.

FIG. 15A is a VSWR characteristics diagram of the third power feed unit G3 on the third side face and FIG. 15B is a VSWR characteristics diagram of the fourth power feed unit G4 on the fourth side face. It can be seen that both antennas provide good VSWR characteristics in wide frequency ranges of 1800 MHz to 2700 MHz.

Figure 16A:
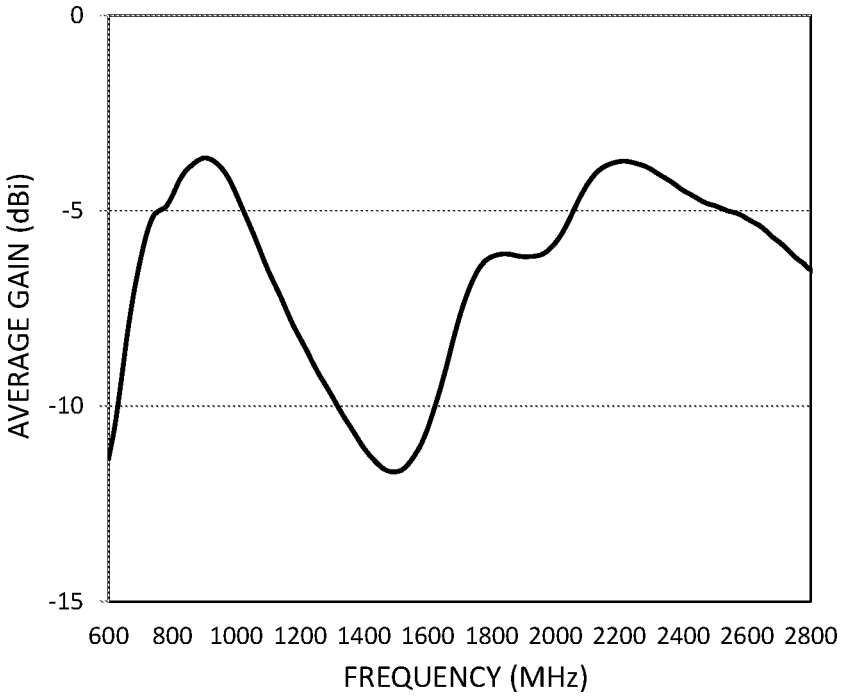
FIG. 16A is a characteristics diagram of average gain (dBi) of a first LTE antenna for vertically polarized waves in a horizontal direction.
Figure 16B:
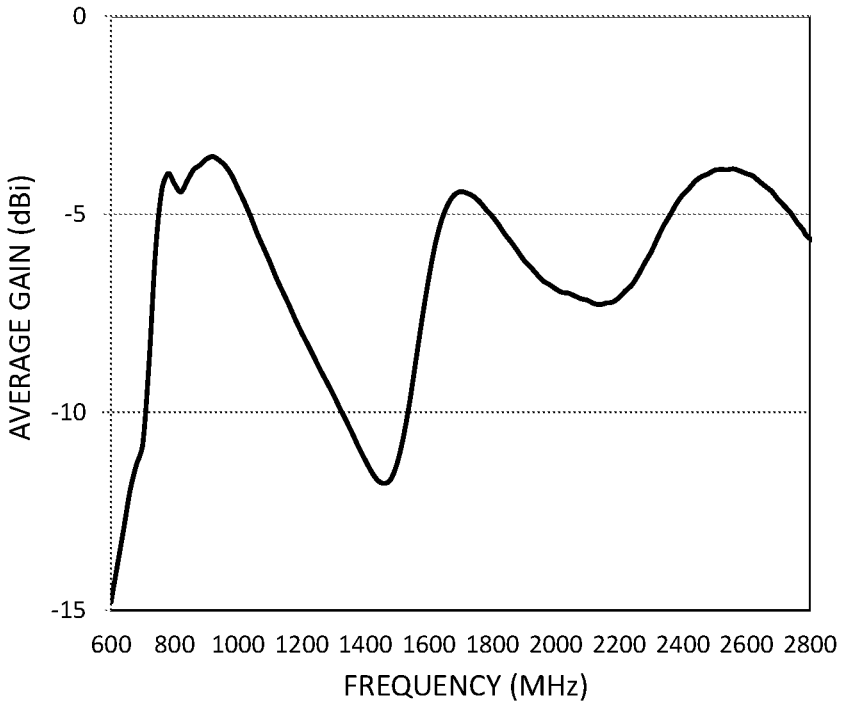
FIG. 16B is a characteristics diagram of average gain (dBi) of a second LTE antenna for vertically polarized waves in the horizontal direction.

FIG. 16A is a characteristics diagram of average gain (dBi) of the first LTE antenna for vertically polarized waves in the horizontal direction and FIG. 16B is a characteristics diagram of average gain (dBi) of the second LTE antenna for vertically polarized waves in the horizontal direction. It can be seen that although the average gain falls in 1100 MHz to 1700 MHz not in use, good average gain (dBi) is obtained in Low Band including the 700 MHz band, 800 MHz band, and 900 MHz band and in High Band of 1700 MHz to 2700 MHz.

Figure 17A:
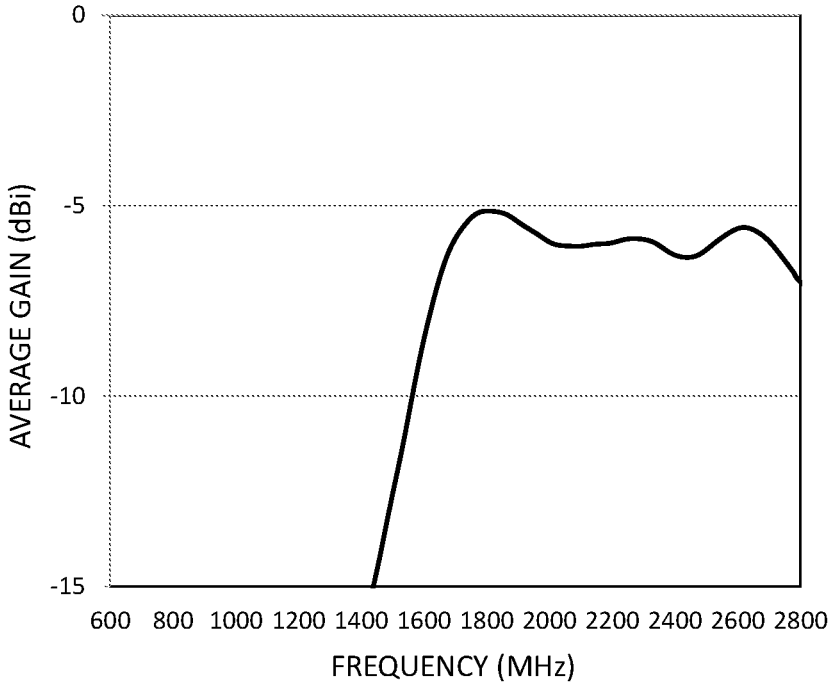
FIG. 17A is a characteristics diagram of average gain (dBi) of a third LTE antenna for vertically polarized waves in the horizontal direction.
Figure 17B:
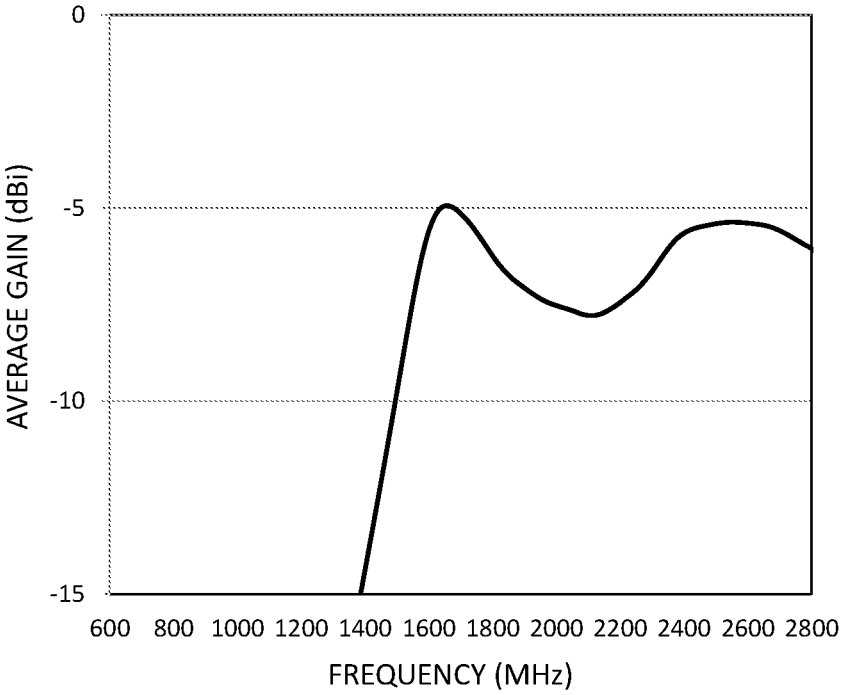
FIG. 17B is a characteristics diagram of average gain (dBi) of a fourth LTE antenna for vertically polarized waves in the horizontal direction.

FIG. 17A is a characteristics diagram of average gain (dBi) of the third LTE antenna for vertically polarized waves in the horizontal direction and FIG. 17B is a characteristics diagram of average gain (dBi) of the fourth LTE antenna for vertically polarized waves in the horizontal direction. Both antennas provide stable gain at 1500 MHz and above.

Effects of Present Embodiment

As is clear from the above description, the antenna device 1 according to the present embodiment includes the first LTE antenna in which the slot 110 extends parallel to the ground plane in the metal surface orthogonal to the ground plane and the slit 111 is provided at a part of edges of the slot 110. In the first LTE antenna, the first power feed unit G1 is provided on inner edges of the slot 110 away from the slit 111 and signals in four frequency bands are transmitted or received via the first power feed unit G1. Consequently, the number of available frequency bands increases compared to when the slit 111 is not provided and limited resources can be used effectively.

Also, since a direction orthogonal to the slot 110 corresponds to main polarization, even if the enclosure is made low-profile, the gain for vertically polarized waves can be maintained and the gain for vertically polarized waves can be increased in the opening direction of the slot 110, i.e., in the horizontal direction. Consequently, by depressing part of the vehicle roof 500 and installing the antenna device 1 shaped and sized to fit in the depression 501 as illustrated in FIG. 1, it is possible to make the antenna device 1 visually unrecognizable from outside while maintaining gain at every azimuth in the horizontal direction. This makes it possible to increase flexibility of vehicle design and achieve such an effect that cannot be obtained from conventional antenna devices of this type from the viewpoint of vehicle design.

Also, since a circuit that exhibits first impedance high enough to limit passage of signals in LTE Low Band and exhibit second impedance lower than the first impedance in LTE High Band is interposed in the aperture in a part of the slit 111 which borders on the slot 110, the antenna device 1 according to the present embodiment can, in LTE High Band, mitigate an impact of the formed slit 111 and thereby stably reduce VSWR.

According to the present embodiment, since the high-pass filter 112 is used as an example of the above-mentioned circuit, the circuit can be implemented, for example, by only an inductive reactance element and easily mounted in the slit 111. A band-pass filter or a band-stop filter may be used instead of the high-pass filter 112.

Also, in the antenna device 1 according to the present embodiment, since the slot 110 is formed across the first side face as well as the third side face and fourth side face orthogonal to the ground plane with the third side face and fourth side face being connected to the ground plane in parallel to each other and with the first power feed unit G1 being provided in the slot in the first side face, area can be saved for slot formation, making it possible to implement a small antenna. Slots may be formed only in the first side face and third side face or only in the first side face and fourth side face.

Also, since the closed ends of the slits 210 and 220 are formed in a direction away from a slot end of the slot 110, impacts of the slits 210 and 220 on the slot 110 in the first side face can be mitigated.

Also, since the second slots (second slot antennas) 310 and 320 capable of transmitting or receiving signals in the V2X band are formed parallel to the ground plane in the metal surfaces (second side face and fourth side face) in which the slot 120 or slit 220 is formed, the antenna device 1 according to the present embodiment can handle a larger number of frequency bands by making effective use of metal surfaces with limited areas.

Also, in the antenna device 1 according to the present embodiment, since the slot 110 of the first LTE antenna and slot 120 of the second LTE antenna are placed in such a way as to be point-symmetrical to each other, it is possible to inhibit mutual interference, for example, when signals of the same frequency are transmitted or received.

In the antenna device 1 according to the present embodiment, since the antennas formed, respectively, on the first side face, second side face, third side face, and fourth side face oriented in different directions at 90 degree intervals in the horizontal direction operate as antennas for MIMO communication via their own power feed units, antennas capable of conducting MIMO communication in all directions are put together in a single enclosure, and, for example, an installation space on the vehicle can be further reduced.

Also, because the height of the enclosure with metal films formed thereon is equal to or less than 20 mm (17 mm), even when a limited space can be secured for the antenna, such as on a vehicle roof, the antenna can be attached easily without reducing antenna performance (e.g., VSWR and horizontal gain). In particular, when part of the vehicle roof 500 is depressed and the antenna device 1 is attached to the depression 501 as described above, the depression 501 can be reduced in size, eliminating the restrictions on the position of the depression 501 and thereby making it possible to further increase flexibility of vehicle design. Also, since gain can be ensured in all directions in the horizontal plane in spite of the small low-profile design, a wide variety of telematics communications can now be implemented in vehicles.

In the antenna device 1 according to the present embodiment, the slots 110 and 120 and slits 111, 121, 210, and 220 formed in plural metal surfaces are linked unicursally. That is, all the metal surfaces are continuous on the enclosure. This eliminates the need to join together the plural metal surfaces, thereby simplifies production of the antenna device 1, and thus makes the antenna device 1 suitable for mass production.

VARIATIONS

In the present embodiment, description has been given of an example of an antenna unit in which elements of plural antennas are formed integrally using the LDS technology, but the method of making an antenna unit is not restrained by the one described in the present embodiment, and, of course, an antenna unit may be constructed by gouging out a metal enclosure.

Also, the types of antennas formed on the first side face to the fourth side face can be changed as desired. For example, the first LTE antenna may be formed on the third side face, the second LTE antenna may be formed on the fourth side face, the third LTE antenna may be formed on the first side face, the fourth LTE antenna may be formed on the second side face, the first V2X antenna may be formed on the first side face, and the second V2X antenna may be formed on the second side face, respectively.

Also, although a rectangular box-shaped enclosure has been described in the present embodiment, the shape of the enclosure is not limited to a rectangular box shape, and may be a polygonal box shape, columnar shape, or elliptic cylinder shape.

Also, the first side face, second side face, third side face, and fourth side face, which are orthogonal to the ground plane in the present embodiment, do not have to be orthogonal to the ground plane. Also, the ground plane may be inclined with respect to the ground. Because gain for vertically polarized waves can be obtained as long as the slot 110, slot 120, slot 310, and slot 320 are parallel to the ground plane, the first side face, second side face, third side face, and fourth side face may be at any angle to the ground plane.

In the antenna device 1 according to the present embodiment, the slots 110 and 120 extend parallel to the ground plane in the metal surface orthogonal to the ground plane, but preferably the slots 110 and 120 are provided in such a way as to extend parallel to the ground.

Also, even when the metal surface is not perpendicular to the ground plane, the slots 110 and 120 can be provided in the metal surface in such a way as to extend parallel to the ground. Similarly, even when the metal surface is not perpendicular to the ground, the slots 110 and 120 can be provided in such a way as to extend parallel to the ground.

In this way, regardless of whether or not the metal surface is perpendicular to the ground plane or the ground, the slots 110 and 120 can be provided in such a way as to extend parallel to the ground.

Also, although the slots 310 and 320 are formed in the present embodiment, the slots 310 and 320 do not necessarily have to be formed.

Also, although the antenna device 1 according to the present embodiment is used for 4×4 MIMO, the antenna device 1 may be used for 2×2 MIMO. In that case, the slits 210 and 220 do not have to be formed.

The invention claimed is:

1. An antenna device for a vehicle, the antenna device being fixed to a predetermined part of the vehicle and comprising at least one metal surface, wherein:

a slot is formed in the metal surface with a slit provided at a part of edges of the slot, the slot having a plurality of slot ends;

the slot faces a direction parallel to a ground plane; and a power feed unit is provided on inner edges between one of the slot ends and the slit, wherein:

the slot includes a first slot end and a second slot end the first slot end and the second slot end facing the power feed unit from opposite directions;

a length from the first slot end to an open end of the slit corresponds to a resonant length of a first frequency band;

a length from the open end of the slit to the power feed unit corresponds to a resonant length of a second frequency band;

a length from the power feed unit to the first slot end corresponds to a resonant length of a third frequency band; and a length from the power feed unit to the second slot end corresponds to a resonant length of a fourth frequency band, wherein:

at least one of the first frequency band to the third frequency band belongs to LTE Low Band; and the fourth frequency band belongs to LTE High Band, wherein an impedance circuit adapted to exhibit first impedance high enough to limit passage of a signal in LTE Low Band and exhibit second impedance lower than the first impedance in LTE High Band is interposed in an aperture in a part of the slit which borders on the slot.

2. The antenna device for a vehicle according to claim 1, therein:

at least one of the first frequency band to the fourth frequency band is a frequency band for telematics.

3. The antenna device for a vehicle according to claim 1, wherein:

the impedance circuit is a high-pass filter, a band-pass filter or a band-stop filter.

4. The antenna device for a vehicle according to claim 1, comprising a plurality of the metal surfaces placed in contact with adjacent ones of the metal surface at a predetermined angle wherein:

the slot is formed across the plurality of the metal surfaces; and the power teed unit is formed on inner edges of a slot in any one of the metal surfaces.

5. The antenna device for a vehicle according to claim 4, wherein:

a second slot adapted to transmit or receive a frequency different from the frequency to be transmitted or received by the slot is formed in the metal surface in which the slot or the slit is formed.

6. The antenna device for a vehicle according to claim 1, further comprising a pair of the slots, wherein the pair of the slots are placed in such a way as to be point-symmetrical to each other.

7. An antenna device for a vehicle, the antenna device being fixed to a predetermined part of the vehicle, the antenna device comprising:

an enclosure which includes a plurality of metal surfaces, wherein a slot is formed in any of the metal surfaces with a slit provided at a part of edges of the slot, the slot having a plurality of slot ends;

the slot faces a direction parallel to a ground plane; and a power feed unit is provided on inner edges between one of the slot ends and the slit, wherein:

the enclosure has four metal surfaces facing in directions, in a horizontal plane, different from one another;

the slot is formed in two opposed ones of the four metal surfaces and a slit antenna is formed on the other two metal surfaces; and the metal surfaces operate as antennas for MIMO communication via respective own power feed units.

8. The antenna device for a vehicle according to claim 7, wherein: the slot is formed across the other metal surfaces adjacent to each other.

9. The antenna device for a vehicle according to claim 8, wherein:

the enclosure is made of resin and the metal surfaces are metal films formed on resin surfaces.

10. The antenna device for a vehicle according to claim 9, wherein:

the enclosure is 20 mm or less in height when the metal films are formed.

11. The antenna device for a vehicle according to claim 10, wherein:

a second slot adapted to transmit or receive a frequency different from the frequency to be transmitted or received by the slot is formed in at least one of the four metal surfaces.

12. The antenna device for a vehicle according to claim 7, wherein:

a patch antenna is placed on the enclosure.

13. The antenna device for a vehicle according to claim 7, wherein:

the slot and the slit formed in the plurality of metal surfaces are linked unicursally and four or more power feed units are included.

14. An antenna device for a vehicle, the antenna device being fixed to an installation part of the vehicle and comprising an enclosure having a plurality of metal surfaces, which are vertically arranged at the installation part, enclosing a predetermined area, wherein:

a slot is formed in at least one of plurality of the metal surfaces with a slit provided at a part of edges of the slot, the slot having a plurality of slot ends;

the slot faces a direction parallel to a ground plane;

a power feed unit is provided on inner edges between one of the slot ends and the slit; and an aperture in a part of the slit which borders on the slot operates as a filter for a high-frequency band.

15. The antenna device for a vehicle according to claim 14, wherein:

the aperture exhibits first impedance in a first frequency band, and exhibits second impedance which is different from the first impedance in a second frequency band.

16. The antenna device for a vehicle according to claim 14, wherein:

the slot is formed across the metal surfaces each of which is placed in contact with other adjacent metal surface.

* * * * *